US006275153B1

(12) United States Patent
Brooks

(10) Patent No.: US 6,275,153 B1
(45) Date of Patent: Aug. 14, 2001

(54) IDENTIFICATION AND TRACKING SYSTEM

(76) Inventor: Andrew Brooks, 261 Sutherland Drive, Toronto, Ontario (CA), M4G 1J4

( * ) Notice: Subject to any disclaimer, the term of this patent is extended or adjusted under 35 U.S.C. 154(b) by 0 days.

(21) Appl. No.: 09/626,068

(22) Filed: Jul. 26, 2000

(51) Int. Cl.[7] ..... G08B 13/14

(52) U.S. Cl. ..... 340/568.6; 340/572.6; 342/51

(58) Field of Search ..... 340/568.6, 572.6, 340/568.1, 10.1, 10.52; 342/51, 42, 44

(56) References Cited

U.S. PATENT DOCUMENTS

| | | | | |
|---|---|---|---|---|
| 4,262,632 | | 4/1981 | Hanton et al. | 425/100 |
| 4,279,433 | * | 7/1981 | Petaja | 340/571 |
| 4,535,322 | | 8/1985 | Yeski | 340/571 |
| 4,603,328 | * | 7/1986 | Larson | 340/666 |
| 4,835,523 | * | 5/1989 | Pruett | 340/571 |
| 5,000,482 | * | 3/1991 | Cimino | 280/809 |
| 5,001,461 | * | 3/1991 | Vroom et al. | 340/572 |
| 5,025,550 | | 6/1991 | Zirbes et al. | 340/573 |
| 5,166,676 | * | 11/1992 | Milheiser | 340/825 |
| 5,211,129 | | 5/1993 | Taylor et al. | 128/655 |
| 5,223,851 | | 6/1993 | Hadden et al. | 340/573 |
| 5,260,689 | | 11/1993 | Meyers et al. | 340/571 |
| 5,281,855 | | 1/1994 | Hadden et al. | 340/573 |
| 5,923,300 | | 7/1999 | Mejia | 340/505 |
| 5,952,935 | | 9/1999 | Meija et al. | 340/505 |
| 5,963,134 | * | 10/1999 | Bowers et al. | 340/572.1 |
| 6,020,818 | | 2/2000 | Chittenden | 340/568.6 |

* cited by examiner

*Primary Examiner*—Jeffrey Hofsass
*Assistant Examiner*—Daniel Previl
(74) *Attorney, Agent, or Firm*—Ridout & Maybee LLP

(57) ABSTRACT

A system for tracking a plurality of recreational items for sliding on snow-covered surfaces of a hill. The system comprises, for each item in the plurality of recreational items, an associated integral ID storing device for storing an associated item ID, the associated item ID being electronically readable from the associated integral ID storing device. The system also comprises an interrogator for reading the associated item ID stored on the associated integral ID storing device for each item in the plurality of recreational items.

13 Claims, 5 Drawing Sheets

24 TRANSPONDER
22

24 TRANSPONDER
22

24 TRANSPONDER
24
20

24 TRANSPONDER
24
20

IDENTIFICATION AND TRACKING SYSTEM

FIELD OF THE INVENTION

The present invention relates generally to an anti-theft system and more particularly to a system for identifying and tracking skis and snowboards.

BACKGROUND OF THE INVENTION

Depending on their quality, skis ("skis" refers to both skis and ski boards) and snowboards can be fairly expensive. Despite this, skis and snowboards are frequently left unattended by their owners. Specifically, ski/snowboard resorts typically have buildings at spaced locations on a hill at which skiers may stop to rest and take refreshment. Skiers and snowboarders remove their skis and snowboards before entering these buildings, and leave their skis and snowboards outside. As a result of skis and snowboards being left unattended, there is an increased possibility of theft.

Prior art devices have been devised to address this problem. For example, U.S. Pat. No. 5,001,461 (Vroom et al) discloses a battery operated motion sensor that is attached to a ski and transmits a radio signal if the ski is moved. A receiver, which can be worn around the neck of the owner of the ski, receives the alarm signal and indicates an alarm condition using, for example, an audible beep. Similarly, U.S. Pat. No. 4,535,322 (Yeski) discloses a battery operated audible signaling device which is activated if a clip is detached. U.S. Pat. No. 6,020,818 (Chittenden) and U.S. Pat. No. 5,260,689 (Merers et al) disclose battery powered devices mounted on skis that emit alarms in appropriate circumstances.

All of these battery powered devices may suffer from disadvantages associated with the use of a battery. Specifically, batteries are both expensive and require recharging periodically. This can be inconvenient for the owner, and it is not unlikely that owners will deliberately forego the additional expense and inconvenience associated with having batteries mounted on their skis or snowboards, despite the anti-theft advantages battery-powered devices provide. Further, if the skis or snowboards are ever stolen, the battery operated signaling device does not provide a means of tracking the skis or snowboards, and, accordingly, does not allow for eventual recovery of the skis or snowboards.

Thus, an anti-theft system for skis that does not rely on batteries and permits the skis to be identified and tracked even after they have stolen, is desirable.

SUMMARY OF THE INVENTION

An object of one aspect of the present invention is to provide an improved recreational item.

In accordance with an aspect of the present invention there is provided a recreational item for sliding on inclined snow-covered surfaces. The recreational item comprises an integral ID storing means for storing an item ID. The item ID is electronically readable from the integral ID storing means.

Preferably the integral ID storing means is a transmitter. In the preferred embodiment, the transmitter is a transponder and the item ID stored thereon is unchangeable.

In accordance with a second aspect of the present invention there is provided a system for tracking a plurality of recreational items for sliding on snow-covered surfaces of a hill. The system comprises, for each item in the plurality of recreational items, an associated integral ID storing means for storing an associated item ID, the associated item ID being electronically readable from the associated integral ID storing means. The system also comprises an interrogator means for reading the associated item ID stored on the associated integral ID storing means for each item in the plurality of recreational items.

Preferably, the associated integral ID storing means for each item in the plurality of recreational items is a transmitter. In the preferred embodiment, this transmitter is a transponder.

According to a further preferred aspect of the present invention, there is provided a system for tracking a plurality of recreational items for sliding on snow-covered surfaces at a plurality of locations. Each location in the plurality of locations has an associated user transport means for transporting an associated set of users of an associated set of recreational items in the plurality of recreational items. The system includes, for each item in the plurality of recreational items, an associated transponder for unchangeably storing an associated item ID, the associated item ID being electronically readable from the associated read only transponder. This system also includes, for each item in the plurality of recreational items, an associated card having a magnetic strip for electronically storing the associated item ID for the item. This system includes, for each location in the plurality of locations, (a) an associated interrogator means for reading the associated item ID stored on the associated transponder for each item in the associated set of recreational items, the associated interrogator means being located within a reading range of the user transport means, and, (b) a card-reading means for reading the associated item ID from the magnetic strip of the card for a recreational item in the plurality of recreational items. Further, the system includes a server for storing a list of item IDs, the server being linked to the associated interrogator means for each location in the plurality of locations and to the associated card reading means for each location in the plurality of locations. The system further includes an ID verification means for checking each associated item ID read by the associated interrogator means for each location in the plurality of locations against the list of item IDs stored on the server, and, alarm means for indicating when the associated item ID read by the associated interrogator means for each location in the plurality of locations corresponds to an item ID stored in the list of item IDs.

BRIEF DESCRIPTION OF THE DRAWINGS:

A detailed description of the preferred embodiments is provided herein below with reference to the following drawings in which.

DETAILED DESCRIPTION OF THE PREFERRED EMBODIMENTS

Figures 1, 2, 3, 4:
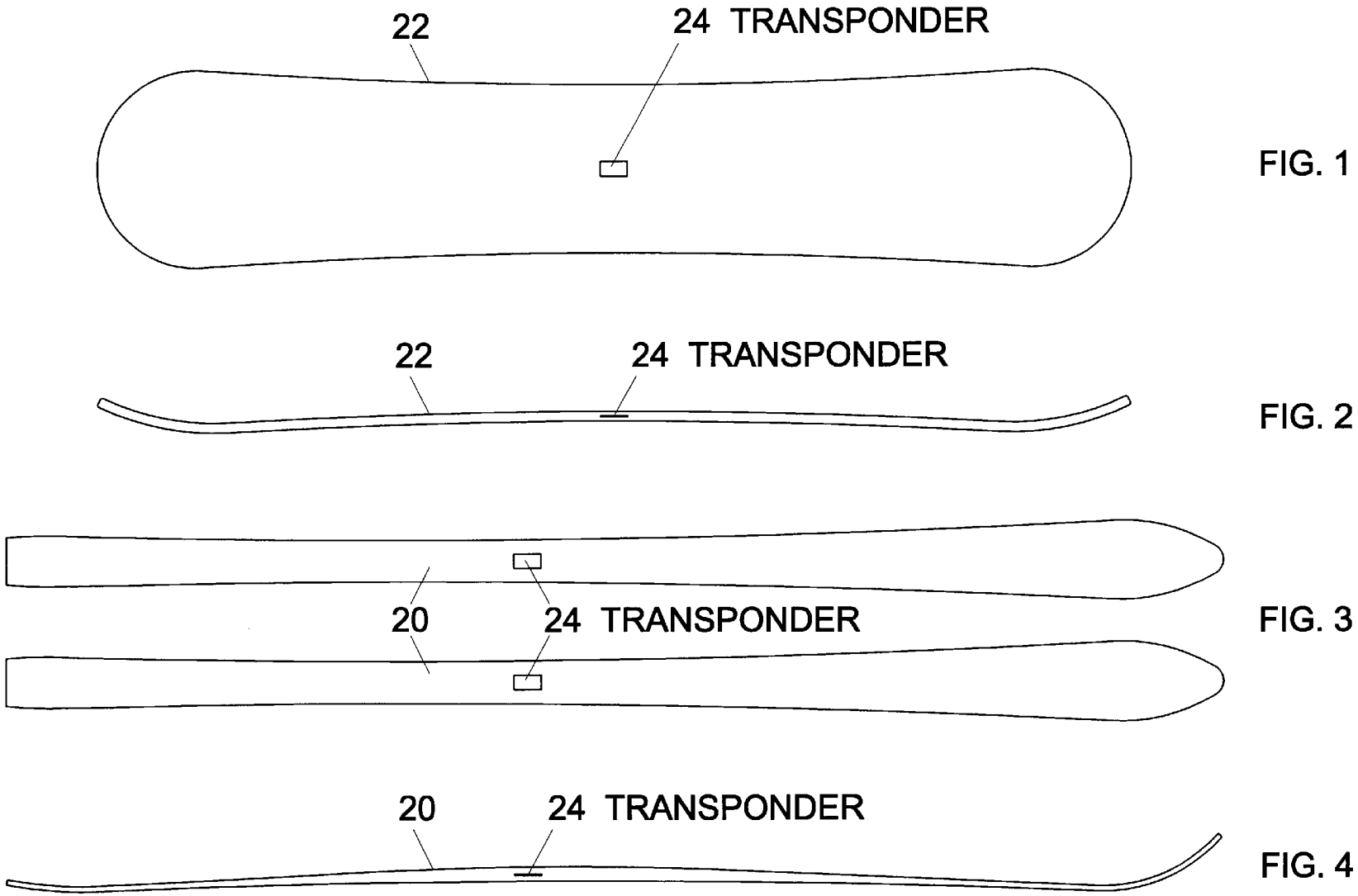
FIG. 1, in a top plan view, illustrates a snowboard in accordance with a preferred embodiment of the present invention.
FIG. 2, in a side view, illustrates the snowboard of FIG. 1.
FIG. 3, in a top plan view, illustrates a pair of skis in accordance with another preferred embodiment of the present invention.
FIG. 4, in a side view, illustrates a ski of the pair of skis of FIG. 3.

Referring to FIG. 1, there is illustrated, in a top plan view, a snowboard in accordance with a preferred embodiment of the present invention. The snowboard 22 includes a transponder 24. Referring to FIG. 2, the snowboard 22 is illustrated in a side view in which the transponder 24 is also shown.

Referring to FIG. 3, there is illustrated a pair of skis 20 in a top plan view. Each ski 20 includes a transponder 24. Referring to FIG. 4, a ski 20 of FIG. 3 is shown in a side view together with a transponder 24. Stored on the transponder 24 is an identification number 28.

Both skis and snowboards are typically constructed by laminating different materials on top of a core material. To impede its removal, the transponder 24 is preferably embedded deep within the ski 20 or snowboard 22, between different layers of laminate.

Figure 5:
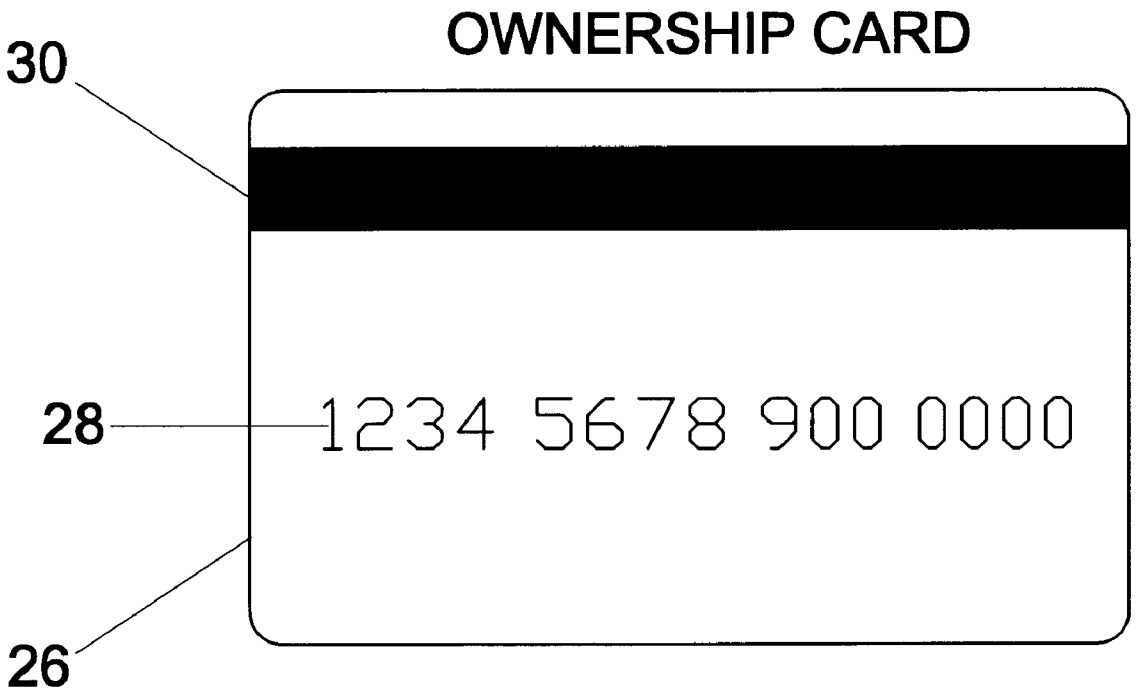
FIG. 5, in a back view, illustrates an identification card 26 in accordance with an embodiment of the invention.

Referring to FIG. 5, there is illustrated an identification card 26 including an identification number 28. The identification number 28 is also stored on a magnetic strip 30 to render the identification card 26 electronically readable. The identification number 28 is also stored on the transponder 24 of either a pair of skis of a snowboard corresponding to the identification card 26.

Each snowboard 22, and each pair of skis 20 is manufactured with a transponder 24 as an integral part thereof such that the transponder 24 cannot readily be removed from the ski 20 or snowboard 22. At some point during or after the manufacture of either the snowboard 22 or the skis 20, the identification number 28 is written on the transponder 24. The transponder 24 is of the type that cannot be subsequently re-written; accordingly, the identification number 28 stored on the transponder 24 is thereafter fixed. When the snowboard 22 or skis 20 are sold, the owner also receives the identification card 26 on which is stored the same identification number 28 that is stored on the transponder 24 of the snowboard 22 or skis 20.

Figure 6:
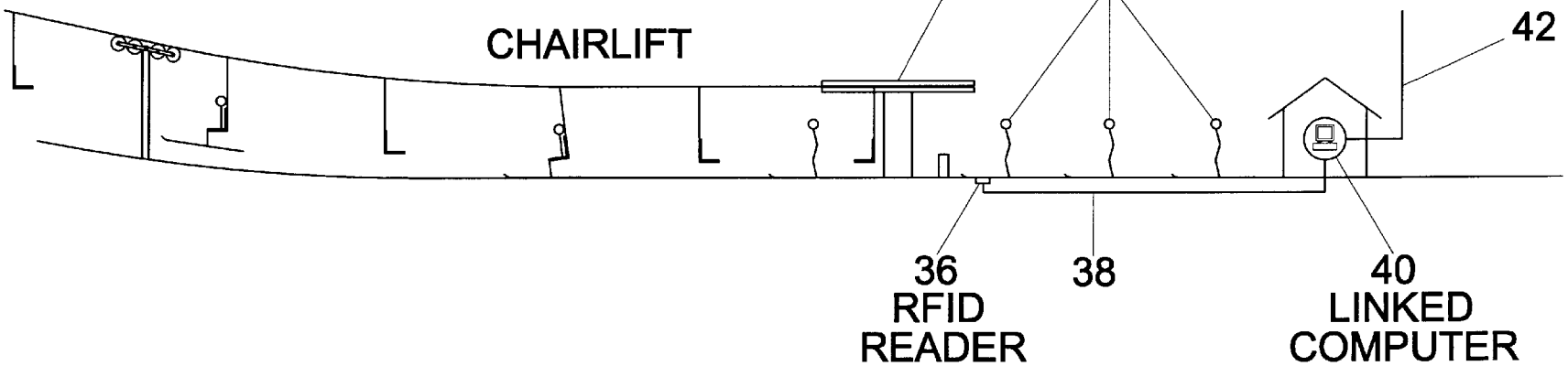
FIG. 6, in a schematic view, illustrates a component of a ski and snowboard tracking system in accordance with a preferred embodiment of the invention.

Referring to FIG. 6, there is illustrated in a schematic view, a hill-side component of a ski and snowboard tracking system in accordance with a preferred embodiment of the invention. In the embodiment of FIG. 6, the hill-side component of the tracking system is implemented around a chairlift. However, it will be appreciated by those skilled in the art that the hill-side component of the snowboard and ski tracking system could also be implemented in any location skis and snowboards must pass for the user to use the hill (for example, aT-Bar lift). In FIG. 5, each of the skiers 34, has passed, is passing, or will pass over a RFID interrogator 36 in order to be transported up the hill by a chairlift 32. The RFID interrogator 36 generates a magnetic field that powers the transponder 24 in snowboard 22 or ski 20. The transponder 24 of the snowboard 22 or ski 20 then transmits the identification number 28 stored thereon back to the RFID interrogator 36. The RFID interrogator 36 is linked via an electronic connection 38 to a hill-side computer 40, which receives the identification numbers 28 read from the snowboards 22 and skis 20. The identification numbers 28 can then be compared with identification numbers stored off site via an Internet connection 42. It will be appreciated by those skilled in the art that while the interrogator 36 of FIG. 6 is shown underneath a position that the skis or snowboards must traverse in order for the user to use the chairlift, the RFID interrogator 36 may also operate at a considerable distance from the skier. For example, the RFID interrogator 36 could be mounted above ground while still permitting operation of the invention.

Figure 7:
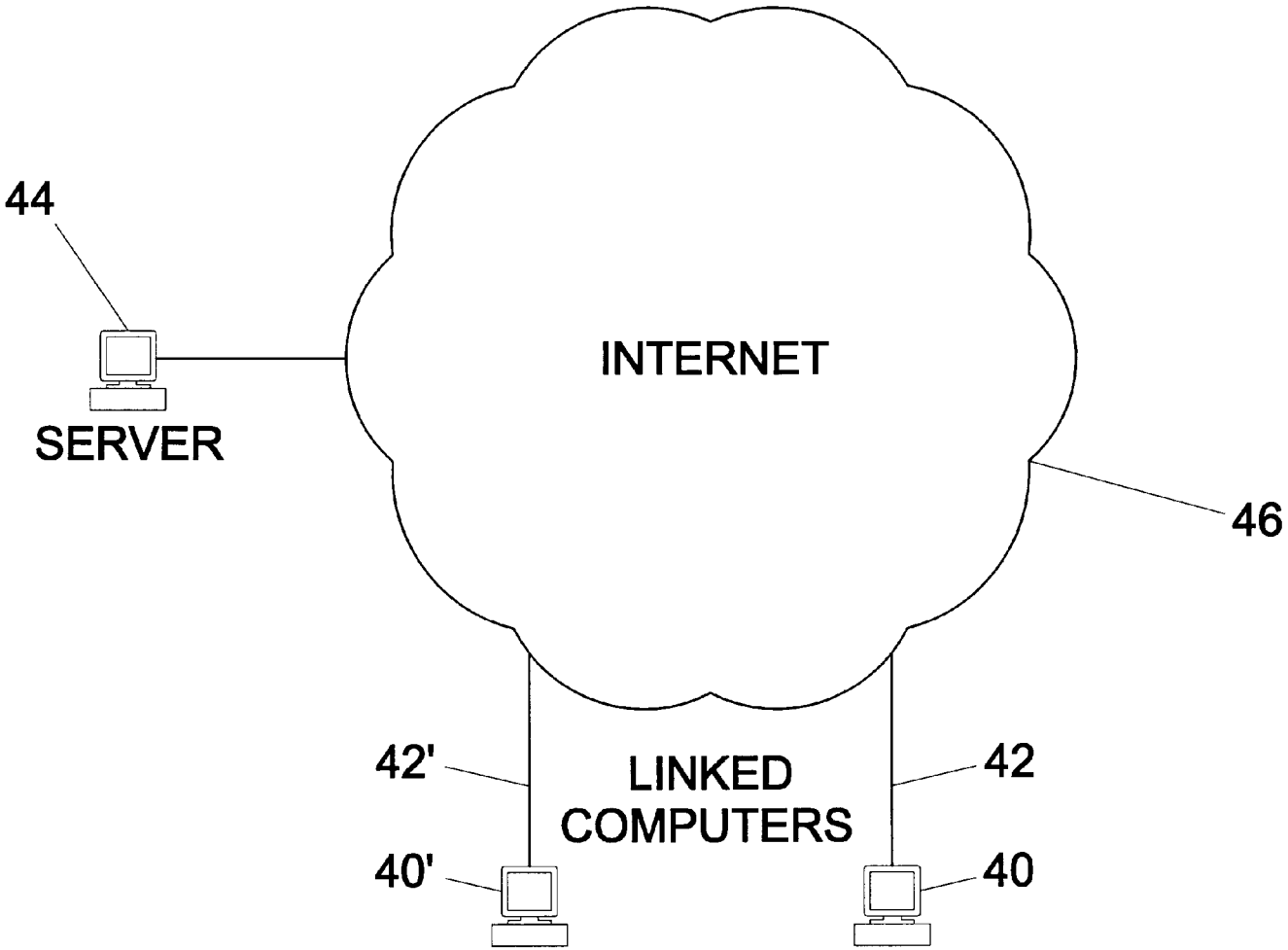
FIG. 7, in a schematic view, illustrates an Internet-side component of the ski and snowboard tracking system of FIG. 6; and, FIG. 8, in a block diagram, illustrates a computer configured to implement an embodiment of the invention.

Referring to FIG. 7, there is illustrated an Internet component of the ski and snowboard tracking system in accordance with a preferred embodiment of the invention. The computer 40 is connected to an Internet 46 via the Internet connection 42. A server computer 44 is also connected to the Internet 46. On the server computer 44, is stored a list of ski and snowboard identification numbers. This list is generated by authorized owners of the skis 20 and snowboards 22 reporting the loss or theft of their equipment. Specifically, when a skier loses her skis 20, she reports this loss to authorities. She provides the authorities with her identification card 26 and the authorities scan in the identification number 28 from the magnetic strip 30 of the identification card 26. This number is then uploaded to the list of identification numbers stored on the server computer 44. Requiring the identification card 26 to report the loss or theft of skis 20 or snowboard 22 impedes misuse of or possible pranks regarding the system—where, say, a pair of skis would be incorrectly reported to be stolen. Referring back to FIG. 7, if the identification number 28 read from a pair of skis 20 or snowboard 22 corresponds to an identification number 28 stored on the server computer 44, then this information will be brought to the attention of the authorities at the hill-side. These authorities can then stop the skier or snowboarder using these skis 20 or snowboard 22 having the suspected identification number 28 to permit them to potentially recover the skis or snowboard.

Referring back to FIG. 7, a parallel computer 40' at another hill-side is also connected to the Internet by an Internet connection 42', and from thence to the server 44. While only one additional computer is shown, any number of different RFID interrogators at any number of different resorts could be connected to the server 44. Thus, using the Internet 46, a centralized repository in the form of the server computer 44 can be used to track all the identification numbers of all of the pairs of skis and snowboards reported stolen, thus facilitating recovery of stolen property. Also, by marking items having the transponder 24, theft may also be discouraged.

Figure 8:
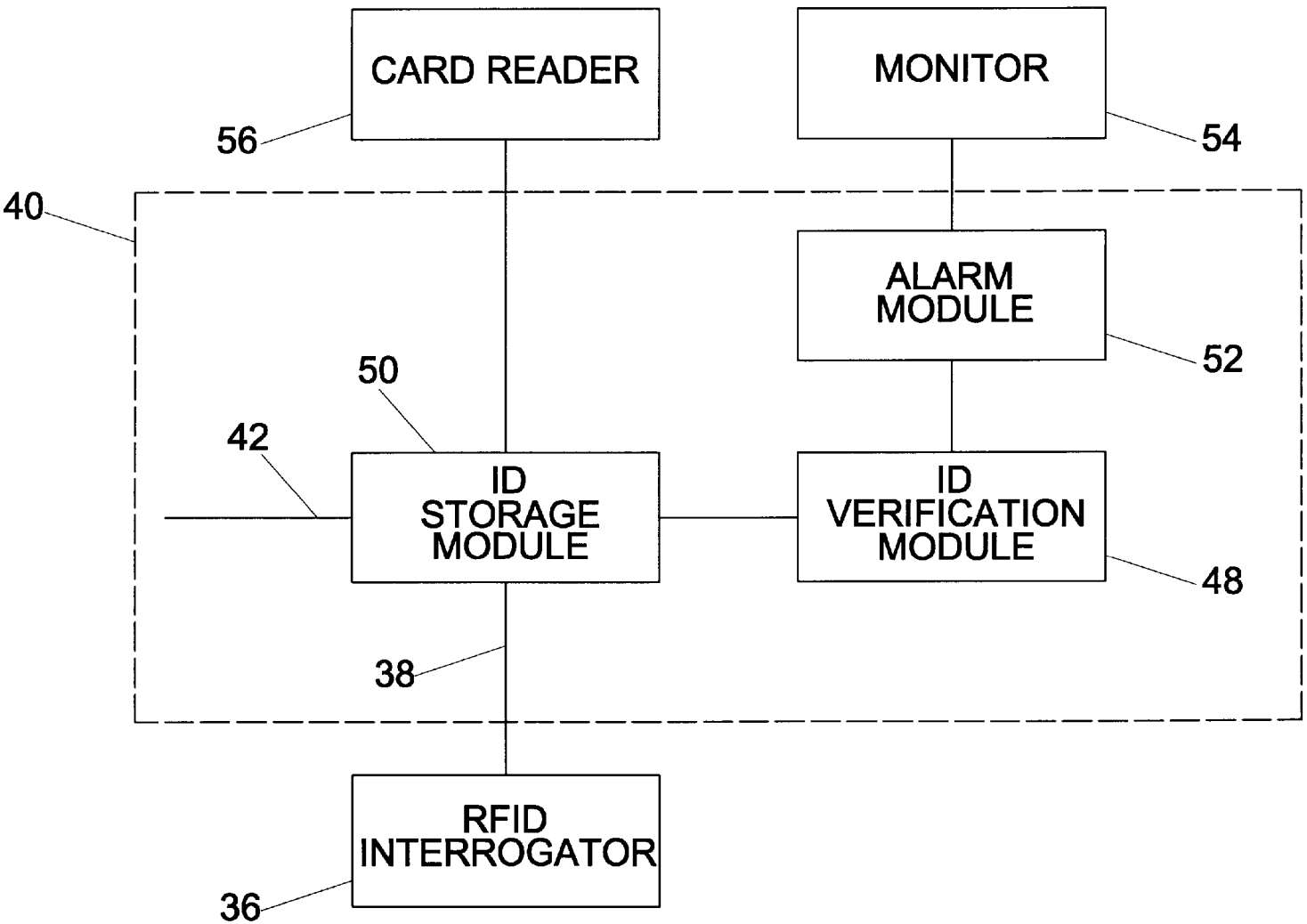

Referring to FIG. 8, the computer 40 is illustrated in a block diagram as configured to implement an embodiment of the invention. The computer 40 includes a monitor 54 and is connected to the RFID interrogator 36 via electronic connection 38. The computer 40 is also linked to a card reader 56 for reading the identification number 28 from the magnetic strip 30 of a card 26, and to the server 44 via internet connection 42. Configured according to the block diagram of FIG. 8, the computer 40 includes an ID verification module 48, an ID storage module 50 and an alarm module 52. In operation, a list of ID numbers is downloaded from the server 44 via internet connection 42 and is stored in the ID storage module 50. ID numbers 28 read by the RFID interrogator 36 are sent to the computer 40 via electronic connection 38 and are also stored in the ID storage module 50. ID verification module 48 then checks each identification number 28 received from the RFID interrogator 36 against the list of identification numbers downloaded from the server 44. If an identification number 28 received from the RFID interrogator 36 corresponds to an identification number 28 in the list of identification numbers downloaded from the server 44, then the alarm module 52 is activated and an alarm is indicated via the monitor 54.

If a skier reports the loss of his skis and produces a card 26, the identification number 28 stored on the card 26 is scanned using the card reader 56. This identification number 28 is then uploaded to the server 44, and will subsequently be downloaded to all resorts (computers 40) connected to the server 44 so that the ID verification module 48 will check the identification number 28 against all identification numbers read by all of the RFID interrogators for that resort. The identification number 28 may also be accessible to appropriate law enforcement agencies to assist them in their investigations and to facilitate recovery of stolen property.

If a card 26 has been lost, then the owner of the skis or snowboard may still have the identification number 28 uploaded to the server, provided the owner can prove ownership of the skis or snowboard having that identification number. This can be done, for example, by providing a purchase receipt to the authorities on which the identification number is written. Preferably, the owner's name will also be written on the card 26 and the owner will have to produce identification proving the owner is the person named on the card 26 before reporting the skis or snowboard to be missing.

The present invention may be embodied in other specific forms without departing from the spirit or essential characteristics. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A system for tracking a plurality of recreational items for sliding on snow-covered surfaces of a hill, the system comprising:

(a) for each item in the plurality of recreational items, an associated integral ID storing means including a transponder for storing a unique associated item ID, the associated item ID being electronically readable from the transponder; and, (b) an interrogator means for reading the associated item ID stored on the transponder for each item in the plurality of recreational items, wherein the hill has an associated user transport means for transporting a plurality of users and the plurality of recreational items; and, the interrogator means for the hill is associated with the user transport means to read the transponder of each item in the plurality of recreational items.

2. The system as defined in claim 1 wherein the user transport means is a chairlift.

3. The system as defined in claim 1 further comprising, for each recreational item in the plurality of recreational items, an associated separate ID storing means for storing the associated item ID apart from the recreational item.

4. The system as defined in claim 3 wherein the associated item ID is electronically readable from the associated separate ID storing means.

5. The system as defined in claim 4 wherein the associated separate ID storing means is a card having a magnetic strip for electronically reading the associated item ID.

6. The system as defined in claim 5 further comprising a card reading means for reading the associated item ID from the magnetic strip of the card for a recreational item in the plurality of recreational items a server for storing a list of item IDs, the server being linked to the interrogator means and to the card reading means;

ID verification means for checking each associated item ID read by the interrogator against the list of item IDs stored on the server; and, alarm means for indicating when the associated item ID read by the interrogator corresponds to an item ID stored in the list of item IDs.

7. The system as defined in claim 1 further comprising a server for storing a list of item IDs, the server being linked to the interrogator means;

ID verification means for checking each associated item ID read by the interrogator against the list of item IDs stored on the server; and alarm means for indicating when the associated item ID read by the interrogator corresponds to an item ID stored in the list of item IDs.

8. A system for tracking a plurality of recreational items for sliding on snow-covered surfaces at a plurality of locations, each location in the plurality of locations having an associated user transport means for transporting an associated set of users of an associated set of recreational items in the plurality of recreational items, the system comprising:

(a) for each item in the plurality of recreational items, (i) an associated transponder for unchangeably storing an associated item ID, the associated item ID being electronically readable from the associated transponder, and (ii) an associated card having a magnetic strip for electronically storing the associated item ID for the item;

(b) for each location in the plurality of locations, (i) an associated interrogator means for reading the associated item ID stored on the associated transponder for each item in the associated set of recreational items, the associated interrogator means being located within a reading range of the user transport means, (ii) a card reading means for reading the associated item ID from the magnetic strip of the card for a recreational item in the plurality of recreational items, (c) a server for storing a list of item IDs, the server being linked to the associated interrogator means for each location in the plurality of locations and to the associated card reading means for each location in the plurality of locations;

(d) ID verification means for checking each associated item ID read by the associated interrogator means for each location in the plurality of locations against the list of item IDs stored on the server; and, (e) alarm means for indicating when the associated item ID read by the associated interrogator means for each location in the plurality of locations corresponds to an item ID stored in the list of item IDs.

9. A method for tracking a plurality of recreational items for sliding on snow-covered surfaces of a hill having an associated user transport means for transporting a plurality of users and the plurality of recreational items, the recreational items each having an associated integral ID storing means for storing an associated item ID, the associated item ID being electronically readable from the associated integral ID storing means, the method comprising the steps of:

(a) providing interrogator means that are associated with the user transport means; and (b) causing the interrogator means to read the associated item ID of the recreational items that are transported by the user transport means.

10. The method of claim 9, further comprising the steps of:

(c) comparing the read associated item ID's to a stored database of item ID's and signaling if one of the read associated item ID's matches one of the stored item ID's.

11. The method of claim 9, wherein the plurality of recreational items are tracked ata plurality of snow-covered hills, each hill having an associated user transport means, and the steps (a) and (b) are respectively performed at each hill, the method including a step of connecting the interrogator means of the plurality of hills to a common electronic network.

12. The method of claim 11 including a step of providing a common database accessible by the plurality of interrogator means through the common electronic network, the common database containing information about at least some of the recreational items.

13. The method of claim 12 wherein the associated item ID's are unique, and including a step of storing in the common database associated item ID's that are associated with recreational items that have been identified as stolen, and including a step of comparing the associated item ID's read by the interrogator means with the stored associated item ID's of the stolen recreational items and indicating when there is a match.

* * * * *